US005425228A

United States Patent [19]

Hillel

[11] Patent Number: 5,425,228

[45] Date of Patent: Jun. 20, 1995

[54] MULTI-COLOR FACETED ROPE CHAIN AND FABRICATION METHOD

[75] Inventor: Benjamin Hillel, Talpiot, Israel

[73] Assignee: Adipaz, Ltd., Jerusalem, Israel

[21] Appl. No.: 297,240

[22] Filed: Aug. 29, 1994

[51] Int. Cl.[6] ..... B21L 5/02

[52] U.S. Cl. ..... 59/80; 59/82; 59/35.1

[58] Field of Search ..... 59/80, 82, 1, 35.1

[56] References Cited

U.S. PATENT DOCUMENTS

| | | | |
|---|---|---|---|
| 944,640 | 12/1909 | Ungerer et al. | 59/1 |
| 1,055,751 | 3/1913 | Hurley | 59/80 |
| 2,424,924 | 7/1947 | Chernon | 59/80 |
| 5,129,220 | 7/1992 | Strobel | 59/80 |
| 5,285,625 | 2/1994 | Ofrat et al. | 59/80 |
| 5,303,540 | 4/1994 | Rozenwasser | 59/80 |
| 5,353,584 | 10/1994 | Strobel et al. | 59/82 |

*Primary Examiner*—David Jones
*Attorney, Agent, or Firm*—Helfgott & Karas

[57] ABSTRACT

A rope chain is fabricated of links comprising an outer layer of a precious metal of a first color and an inner metal layer of a second color. The links are intertwined to form a rope chain. The links are faceted by diamond cutting techniques wherein the outer surface is partially sheared from the link to a depth such that an area of inner material of the second color becomes exposed and a two-tone link is produced. Facets having more than two color bands can also be produced.

12 Claims, 2 Drawing Sheets

MULTI-COLOR FACETED ROPE CHAIN AND FABRICATION METHOD

BACKGROUND OF THE INVENTION

This invention relates generally to rope chain jewelry and more particularly to rope chain jewelry of the diamond cut faceted type.

A rope chain may be made up of annular links formed of solid wire, usually a precious metal such as gold. The wire is formed into a C-shape, or may be a continuous loop by sodering the ends of the wire together after bending into a generally C-shape. In a known manner, a multiplicity of such individual links are intertwined to form, in outward appearance, a double helix rope chain.

In order to reduce the weight of precious metal, and thereby reduce the cost of a finished item without any compromise in aesthetic appearance, rope chains have been made using hollow links. After formation, the individual hollow links are intertwined, just as the solid links are intertwined, to form what is known as a hollow rope chain.

Different appearances have been achieved for the solid link rope chains by using links of different,cross sections and also by providing facets on the external surfaces of the rope chain. The facets are produced in a process known in the trade as "diamond cutting" by shearing away external portions of link surfaces, and many attractive patterns are the results. By faceting a solid link rope chain on four sides, a square shaped rope has been produced. Also, faceting has been done on six sides and on eight sides to provide hexagonal and octagonal appearances. The faceting may be applied along the entire length of the rope or only in selected portions. Additionally, the flattened sheared surfaces that comprise a facet, while generally running in a straight line lengthwise of the rope chain, have been made to run in a spiral around the rope, the spiral corresponding with the double helix of the chain itself.

Naturally, whenever a new faceted appearance is generated in a rope chain having solid links, there is an impetus to reproduce the same appearance in hollow link rope chains so that a lower cost version of the solid link faceted chain may be made available to the buying public at lower cost and without sacrifice in aesthetic appearance.

Because the metal in the hollow links is so thin, e.g., 0.0025 inches, it has not been possible to facet hollow link rope chains by the shearing technique that removes metal from the surface of the links. Such a machining approach to faceting can easily produce holes in the surface of the very thin metal, and destroy the appearance and worth of the rope chain.

Therefore, alternative techniques to provide the effect of faceting without shearing away material have been developed, and have proven to be successful in simulating the appearance of sheared facets. These techniques for faceting generally involve deformation of the hollow links by application of lateral forces to the surface of the hollow link and bending the link wall. Precise control over this bending and bending in small repeated increments produces flat surfaces that give the appearance of a sheared facet.

Although there are numerous variations of rope chains now available on the market, with and without facets, solid and hollow link, etc., there is always demand for a new aesthetic appearance design to stimulate market growth and development. Whereas rope chains using links of different colors are readily provided, it is difficult and expensive to provide a rope chain wherein individual links are faceted with multi-color effects.

What is needed is an economic multi-color faceted rope chain.

SUMMARY OF THE INVENTION

It is an object of the present invention to provide an improved rope chain for use in jewelry and manufacturing method that provides a new aesthetic visual appearance.

Another object of the invention is to provide an improved rope chain and manufacturing method that provides multi-color facets in any of straight line and spiral arrangements, as known in the prior art.

Still another object of the invention is to provide an improved rope chain and manufacturing method that is multi-color faceted and is manufactured by techniques similar to those presently used in the industry in producing rope chain jewelry.

The rope chain in accordance with the invention is fabricated of links comprising an outer layer of a precious metal of a first color and an inner layer or core of a metal of a second color. The links may be faceted after formation and prior to intertwining with other links in order to form a rope chain, or the link may be faceted after it has been incorporated, with many other similar links, into a rope chain, as is known in the art.

The faceting is effected by diamond cutting techniques wherein the outer surface of the link is partially sheared away to provide a flat surface. In this instance, material is sheared from the link to a depth such that an area of inner material of the second color becomes exposed where the outer layer was sheared away, and a two-tone link is produced.

An entire rope chain can be produced using only two colors of metal. However, links having different color combinations can be used in the same rope chain, as suits the preference of the designer of jewelry pieces.

A solid multi-color link can be produced by wrapping a thin sheet of precious metal around a circular rod, wire, or core of the second metal of the second color, using the same techniques as are now used in providing hollow links for hollow link rope chains. However, contrary to the prior art of producing monochromic hollow links, wherein the central core is melted out or eaten out by acid or caustic after the links have been formed, in the present invention the central core remains a portion of the completed link. Subsequently, the link is faceted by shearing away material until both materials are exposed.

All previously known techniques for faceting solid link rope chains may be utilized in faceting the multicolored faceted rope chain of the present invention.

In an alternative embodiment in accordance with the invention, a hollow double-layered link is used in forming an intertwined rope chain. The faceting is accomplished by shearing away material of the outer layer until an area of the inner layer of material is exposed. However, the shearing action is limited to a depth that does not penetrate the inner layer of material. Thus, a hollow link rope chain is provided, although with a heavy double wall construction. The aesthetic qualities of the solid link rope chain may be achieved using these hollow links with the same multi-color effect, but at a lower investment in precious material.

The invention accordingly comprises the several steps in a relation of one or more of such steps with respect to each of the others, and the article possessing the features, properties and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
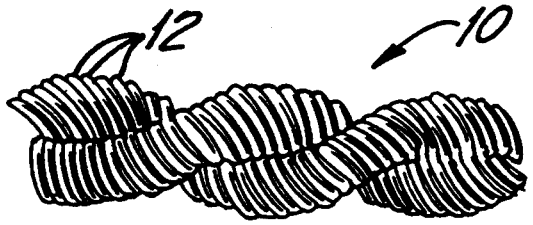
(PRIOR ART) FIG 2
FIG. 2 is a segment of an unfaceted jewelry rope chain of the prior art.

FIG. 2 illustrates a segment of a double-helix rope chain 10 as is used to make necklaces, bracelets, and the like. Constructions of rope chains are well known in the jewelry arts. The rope chain 10 is made by intertwining many similar links 12, which, as illustrated, is a hollow toroid with a gap 14 between the ends of the link and a longitudinal seam 16 running around the inside of the link such that the link is similar to an automobile tire except that a segment is missing from the circumference. A rope chain 10 made from such links 12 is known as a hollow link rope chain.

The links 12 are made by taking a flat sheet of thin precious metal, for example, gold, and wrapping it around a non-precious core wire, which may be aluminum or copper, leaving the seam 16, with a second gap 17, around the periphery. The elongated rod, thus formed, is then wrapped around a mandrel in a spiral-like fashion and is cut into sections to form the links with the small gaps 14, 17. The links are typically flattened so that they lie in a plane. The core is removed by melting or by action of an acid or caustic soda as is appropriate to the non-precious metal used for the core. The completed links 12 are then intertwined in the known manner to make the rope chain 10.

It should be understood that the order of steps described above may be varied, and the thin layer of precious metal may be applied to a solid non-precious core by other known techniques, for example, by drawing the core and thin sheet of precious metal through a round die, as described in U.S. Pat. No. 5,129,220 so that the sheet of precious metal forms an open tube with a non-precious metal core.

U.S. Pat. No. 4,651,517 to Benhamou gives details of techniques used in intertwining links, whether hollow or solid, to form a rope chain. Such rope chains can be faceted, for example, as described in U.S. Pat. No. 5,129,220 to Strobel. These patents are incorporated herein by reference. Forming a rope chain from links is not a novel portion of the present invention and, accordingly, is not described in detail herein.

It has been found desirable in the jewelry markets to provide faceted rope chains. However, applying facets to links individually, or after intertwining so as to form the rope chain, presents added difficulties where hollow links are employed. It is relatively simple to shear away the outer surface of solid links to provide facets, but similar procedures if applied to hollow links can cause holes in the wall of the link, whereby the attractiveness and salability of the jewelry is lost. Nevertheless, techniques have been developed in the prior art whereby hollow links in a rope chain can be given the appearance of sheared facets, and still enjoy an economy in using the hollow links.

Figure 1:
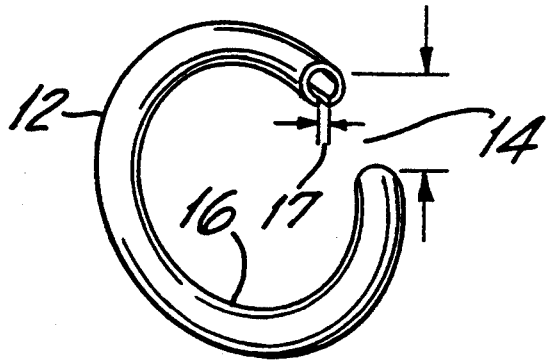
(PRIOR ART) FIG. 1
FIG. 1 is a typical link used in construction of a jewelry rope chain in accordance with the prior art.
Figure 3:
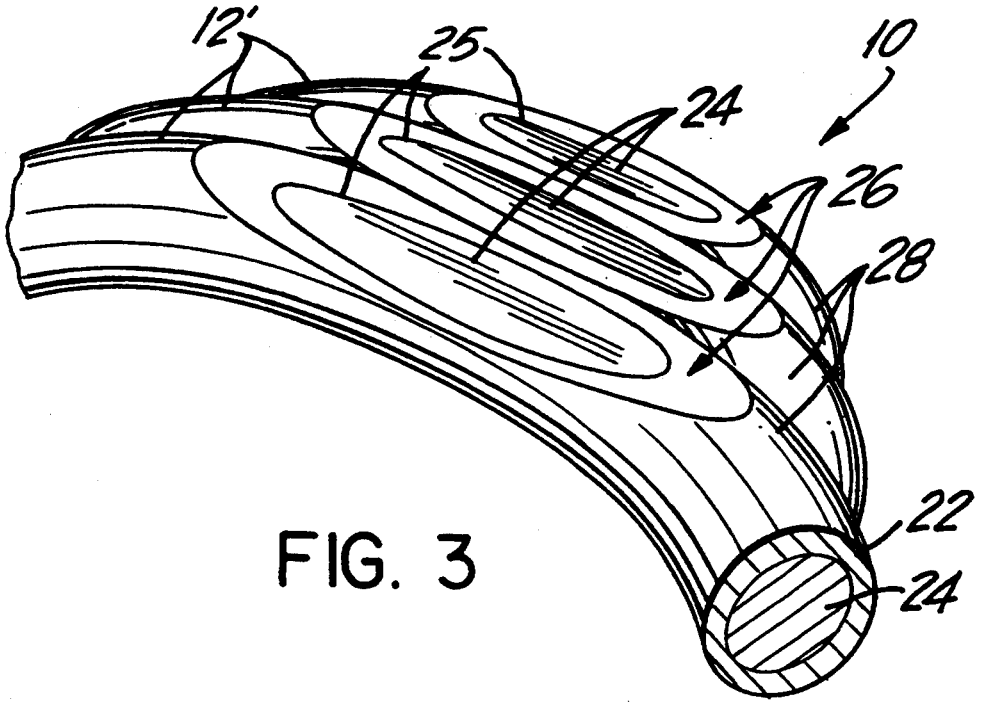
FIG. 3 is a partial sectional perspective view to an enlarged scale of several adjacent faceted links in accordance with the invention.

FIG. 3 illustrates several adjacent links 12' of a rope chain 10 in accordance with the invention. Only a segment of the chain 10 is illustrated to an enlarged size for the sake of clarity. The links 12' conform to the general toroidal configuration of FIG. 1, but not including a gap corresponding to the gap 14, although such a gap is not precluded. That is, the link 12' is solid. The link 12' includes an outer layer 22 of precious metal and a solid central core 24, which is also of metal that may or may not be a precious metal. Generally, though, both layers 22, 24 would be precious metal, for example, gold or silver, but non-precious metals may be incorporated, e.g., copper. The metals for the layers 22, 24 have different colors. That is, layer 22 may be, for example, yellow gold and layer 24, for example, may be white gold, pink gold or copper.

After the links 12' are intertwined to form a rope chain, the solid links may be given facets 26 by shearing away (diamond cutting) a portion of the outer surfaces 28 of the links 12'. By shearing to sufficient depth, an area defined by an interface line 25, of the central core 24 becomes visible on the facet surface and a two-color facet is provided on the individual links 12'. This provides an attractive, novel appearance for the rope chain 10. As is known, the diamond cutting technique may produce different sizes of sub-facet areas on respective links.

Figure 4:
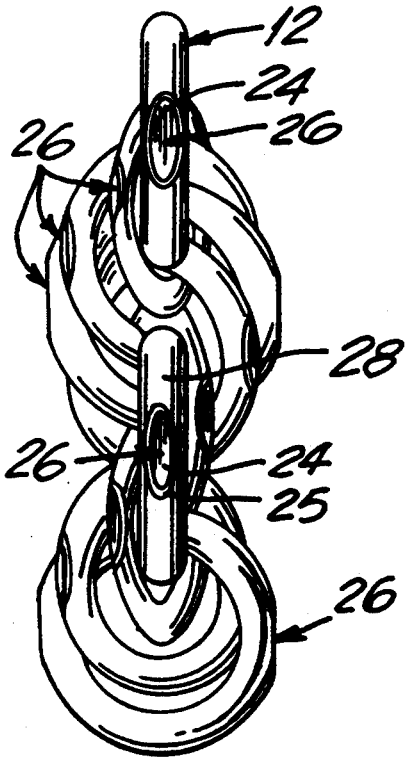
FIG. 4 is a segment of a jewelry rope chain in accordance with the invention having a spirally faceted construction.

It is also known that the rope chain can be diamond cut for a square, hex or octagonal shape, or by any other technique which is known, including production of a spiral faceted configuration (FIG. 4) as in Strobel, U.S. Pat. No. 5,129,220. These forming technique of the prior art are applicable when using the link 12' in accordance with the invention to form a rope chain.

Figure 5:
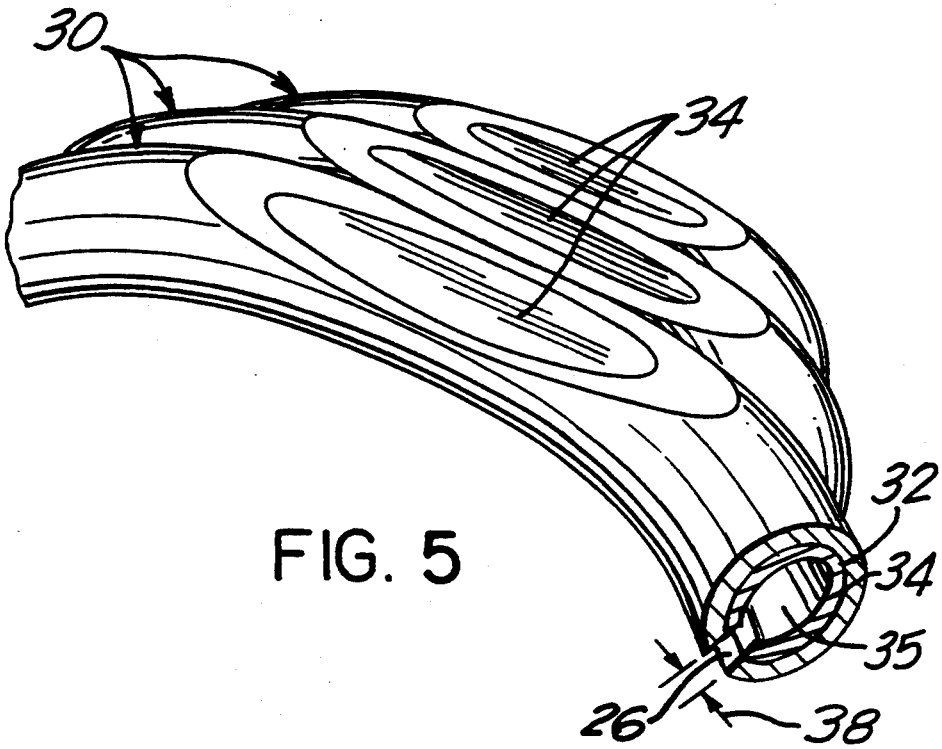
FIG. 5 is a view similar to FIG. 3 of an alternative embodiment in accordance with the invention.

An alternative embodiment of a link 30 for use in rope chains in accordance with the invention, is illustrated in FIG. 5. The link 30 has an outer layer 32 of precious metal, a generally concentric inner layer 34 of precious metal, and a hollow center 35. A longitudinal seam 36 extends along the inner circumference of the link 30, which has a generally annular shape, as in the link 10 illustrated in FIG. 1, and a gap 38 separates the edges of the link.

A rope chain, when sheared by diamond cutting techniques that remove material from the outer peripheral layer 32 of the hollow links 30, exposes portions of the inner layers 34 so that an aesthetic appearance similar to that illustrated for the solid link of FIG. 3 is achieved, but with a reduced input of precious materials.

The link 30 may be produced by wrapping the layer 34 and then layer 32 around a rod (not shown in FIG. 5) of non-precious metal. Then, as before, the resultant rod may be spiralled around a mandrel, cut into suitable lengths, and flattened. The non-precious metal center rod is removed by melting or chemical action so that a lighter weight link 30 is provided, having the same appearance after faceting as the solid link.

In performing the diamond cutting shearing operations, care must be taken that the inner layer 34 is not penetrated by excessive removal of material.

Figure 6:
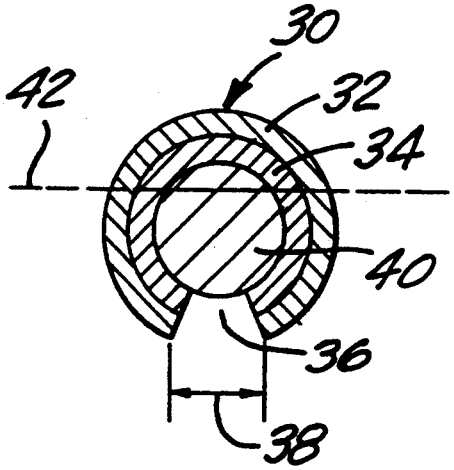
FIG. 6 is a cross section of a link in another alternative embodiment in accordance with the invention.

In another alternative embodiment, FIG. 6, the core 40 or rod used in preparing the links dr. FIG. 5 is made of metal which can be different in color from the layers 32, 34, or the same as the layer 32 in color. The core 40 is not removed. When faceting, by shearing of the layers 32, 34, 40 to a depth as indicated by the broken line 42, a tri-color effect can be produced in the facet of an individual link 30'. At least in theory, depending upon the number of layers which are used in constructing the link, the facet can display areas of different colors, with a band of color representing each cross sectional layer in the link.

The multi-color rope chains of the invention are produced by adapting well-known manufacturing techniques to links of novel construction that are formed into a rope chain.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

What is claimed is:

1. A method for fabricating a multi-color faceted rope chain, comprising the steps:

(a) forming a plurality of annular links, each said link having a cross section including at least a first metal portion and a second metal portion, said first and second portions being metals of different colors, said first portion forming an outer periphery of said annular link, said second portion forming an interior core of said annular link;

(b) intertwining said plurality of links to form a rope chain;

(c) diamond cutting said rope chain to form facets by removing metal from a region of said first metal portion to a depth that exposes an area of said second portion in a facet that juxtaposes said different colors of said metals.

2. A method as in claim 1, wherein at least one of said portions is a precious metal.

3. A method as in claim 1, wherein said core formed by said second portion is one of solid and hollow.

4. A method as in claim 1, wherein in step (a), said ring is formed including at least a third metal portion, said second portion having a generally annular concavity, said at least a third portion being positioned within said concavity, and wherein in step (c), metal is removed until an area of said at least a third portion is also exposed at said facet, the color of said at least a third portion differing from the color of any adjacent exposed portion, whereby at least a three-color faceting is provided.

5. A method as in claim 1, wherein said links are solid, said first portion forming an outer layer on said link and said second portion forming a core of circular cross section.

6. A multi-colored faceted rope chain, comprising:

a plurality of links intertwined to form a rope chain, at least a portion of said links having a cross section including an outer layer of a metal having a first color, and a first inner layer of a metal having a second color, said layers being in contact with each other, a region of said outer layer having been removed to a depth to expose an area of said first inner layer and form a two-color facet.

7. A rope chain as in claim 6, wherein said facet has a generally flat face.

8. A rope chain as in claim 6, wherein said links are generally annular in shape.

9. A rope chain as in claim 8, wherein said first inner layer is one of hollow and solid in cross section.

10. A rope chain as in claim 6, wherein said links further include a second inner layer of metal of a color different from said first inner layer, said second inner layer being positioned in a concavity of said first inner layer, said region of said outer layer being removed to a depth to expose areas of said first inner layer and said second inner layer and to form a three-region facet of at least two colors.

11. A rope chain as in claim 10, wherein said second inner layer is one of hollow and solid in cross section.

12. A rope chain as in claim 6, wherein said first inner layer is one of hollow and solid in cross section.

* * * * *